US006244773B1

(12) United States Patent
Geremia-Nargi

(10) Patent No.: US 6,244,773 B1
(45) Date of Patent: Jun. 12, 2001

(54) ADHESIVE FILM REMOVER TOOL

(75) Inventor: Mary E. Geremia-Nargi, Wallingford, CT (US)

(73) Assignee: Manco, Inc., Avon, OH (US)

( * ) Notice: Subject to any disclaimer, the term of this patent is extended or adjusted under 35 U.S.C. 154(b) by 0 days.

(21) Appl. No.: 09/374,183

(22) Filed: Aug. 13, 1999

(51) Int. Cl.[7] ..... B43K 29/00

(52) U.S. Cl. ..... 401/195; 401/264; 401/202; 401/205

(58) Field of Search ..... 401/195, 52, 98, 401/124, 293, 262, 269, 264, 202, 205; D32/46, 48, 49; 220/212

(56) References Cited

U.S. PATENT DOCUMENTS

| | | | | |
|---|---|---|---|---|
| D. 221,244 | * | 7/1971 | Lawrence | D44/1 |
| D. 352,003 | | 11/1994 | Groene et al. . | |
| D. 355,576 | | 2/1995 | Groene et al. . | |
| D. 356,259 | | 3/1995 | Hoyt . | |
| D. 366,402 | | 1/1996 | Groene et al. . | |
| D. 371,494 | | 7/1996 | Groene et al. . | |
| 1,142,811 | | 6/1915 | Griswold . | |
| 1,227,122 | | 5/1917 | Eberhart . | |
| 1,407,955 | | 2/1922 | Smalley . | |
| 1,890,314 | | 12/1932 | Crane . | |
| 2,380,855 | * | 7/1945 | Lower | 15/236 |
| 2,716,251 | | 8/1955 | Pearce . | |
| 2,886,839 | | 5/1959 | Leopoldi . | |
| 2,972,161 | * | 2/1961 | Roehrich | 401/264 |
| 2,982,987 | | 5/1961 | Knapp . | |
| 3,113,703 | | 12/1963 | Rundle . | |
| 3,722,021 | | 3/1973 | Brainerd et al. . | |
| 4,079,030 | | 3/1978 | Takanen et al. . | |
| 4,128,452 | | 12/1978 | Johnson et al. . | |
| 4,322,252 | | 3/1982 | Plumb . | |
| 4,652,163 | | 3/1987 | Karliner et al. . | |
| 5,009,343 | | 4/1991 | Pugatch . | |
| 5,301,843 | | 4/1994 | Groene et al. . | |
| 5,333,967 | | 8/1994 | Foley et al. . | |
| 5,788,104 | | 8/1998 | Hoyt . | |

FOREIGN PATENT DOCUMENTS

| | | |
|---|---|---|
| 29 21 633 | 12/1980 | (DE) . |

* cited by examiner

*Primary Examiner*—David J. Walczak
(74) *Attorney, Agent, or Firm*—Vickers, Daniels & Young

(57) ABSTRACT

An adhesive, paint and adhesive film removal tool provides different scraping edge configurations for different substrates. The removal tool has a gripping portion which acts also as a bottle cap and a blade portion having a gently curved portion, a straight edge portion and a sharp edge portion allowing one to remove adhesive, paint and adhesively bound film from a variety of substrates.

36 Claims, 2 Drawing Sheets

Fig. 1
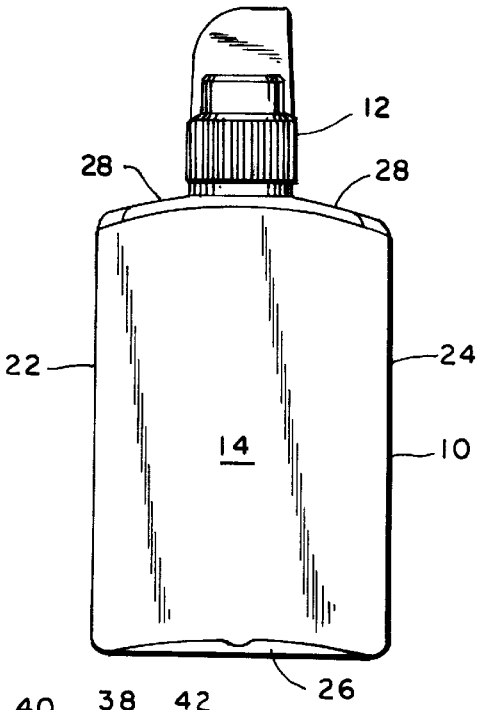
Fig. 2
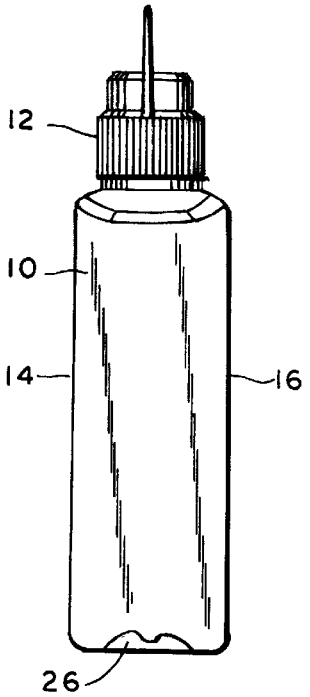
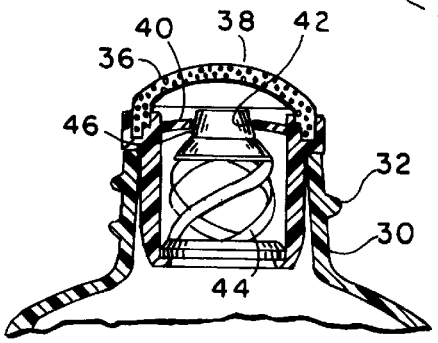
Fig. 3
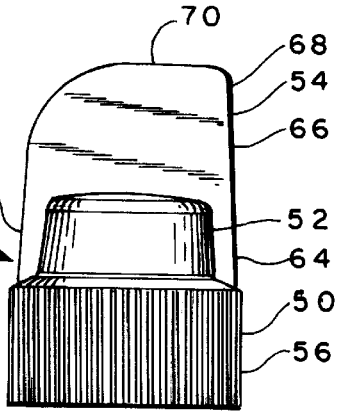
Fig. 4
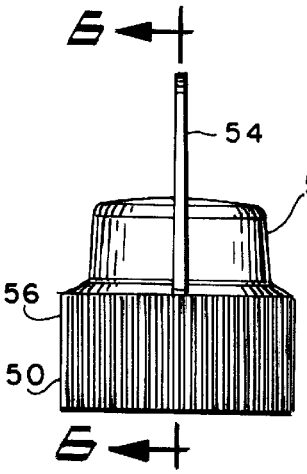
Fig. 5

ADHESIVE FILM REMOVER TOOL

FIELD OF THE INVENTION

This invention relates to a tool for removing adhesive films from substrates. More particularly, the invention relates to a scraper adapted to remove adhesives, adhesive labels, tags, cured and uncured polymer films, such as sealants, paints, and the like from a substrate.

BACKGROUND OF THE INVENTION

Many products are purchased by consumers having adhesive tags, labels and other materials attached to them. Additionally, some products intentionally or unintentionally, have areas of adhesive, paint, pigment, or other coatings on them which must be removed. Removal of such tags, materials and other blemishes from products, especially smooth surfaced or delicate products, has been a problem for many people in the past. This is true for both consumers and businesses.

A tag on a product is sometimes removed by the consumer by a using a fingernail. This often results in incomplete removal of the tag and often leaves a residue of adhesive in place. Sometimes, consumers will attempt to clean paint splatters or adhesive residues from products with a paper towel or sharp implement and water, rubbing alcohol, acetone, other solvents, or the like. The adhesive is sometimes slightly softened by the alcohol and retains portions of the paper towel on the substrate intended to be cleaned. If one is not succeeding with a fingernail or paper towel, one will often turn to a kitchen knife or something more aggressive and dent, scratch or otherwise damage a product or substrate. One often creates a bigger mess than one had to begin with.

People often use some kind of a solvent to remove paint splotches, adhesive marks, tags, stickers, and the like. People also often use scrapers of one kind or another to do this job. However, the two items are often stored separately leaving the consumer to use only one of the two, the solvent or the scraper, because they cannot find the other.

Thus, removal of paint spots, adhesive residue, labels, stickers, and the like from substrates in the past has been a frustrating proposition for most people.

SUMMARY OF THE INVENTION

The present invention provides a tool for removing adhesive, paint splatters, adhesive tags, stickers, decals and/or polymer film from a substrate, the tool comprising a bottle cap having gripping portion and a blade portion, the blade portion having a sharp corner, a straight portion and a rounded portion.

Further in accordance with the invention, the cap is fabricated from a polymeric material which is relatively stiff and the blade is tapered from its base to its leading edge so that a small amount of flexibility with elastic recovery is provided at the leading edge of the blade.

Yet further in accordance with the invention, the cap can be firmly attached to a solvent containing bottle allowing one to use the cap as a tool either on the bottle or off the bottle for working in tight areas.

Still further in accordance with the invention, the tool acts both as a scraping tool and as a closure for a solvent bottle whereby the tool will normally be kept with the solvent bottle and is readily available for use.

Still further in accordance with the invention, the base of the tool provided with ridges around its periphery making the tool easily grippable either on or off the bottle.

It is principal object of the present invention to provide an adhesive removing tool which will cleanly and easily remove adhesive, paint splatters, adhesive tags, and the like from a substrate without damaging the substrate.

It is another object of the present invention to provide an adhesive removing tool which can be used when attached to a bottle of adhesive remover or separately from the bottle of adhesive remover.

It is yet another object of the present invention to provide an adhesive removing tool that can be used in restricted or awkward locations.

It is still another object of the present invention to provide an adhesive removing tool having a scraping edge with a variety of curvatures whereby adhesive, paint, labels, and the like can be removed from substrates with a variety of configurations.

It is another object of the invention to provide an adhesive removing tool which can remove blemishes of irregular shape and tenacious composition.

It is another object of the present invention to provide an adhesive remover tool which is inexpensive to manufacture, easy for the user to maintain, and efficient in use.

These and other objects of the present invention will become apparent to those skilled in the art from the following description taken in conjunction with the accompanying drawings wherein:

FIG. 1 is a front elevation of the complete tool engaged to a solvent bottle;

FIG. 2 is a side elevation of the tool and bottle of FIG. 1;

FIG. 3 is a detailed view of the neck of the bottle of FIGS. 1 and 2 and the solvent applicator contained in the neck with the tool remover, FIG. 4 is an enlarged front elevation of the tool seen in FIGS. 1 and 2;

FIG. 5 is a side elevation of the tool seen in FIG. 4;

PREFERRED EMBODIMENT

Figure 6:
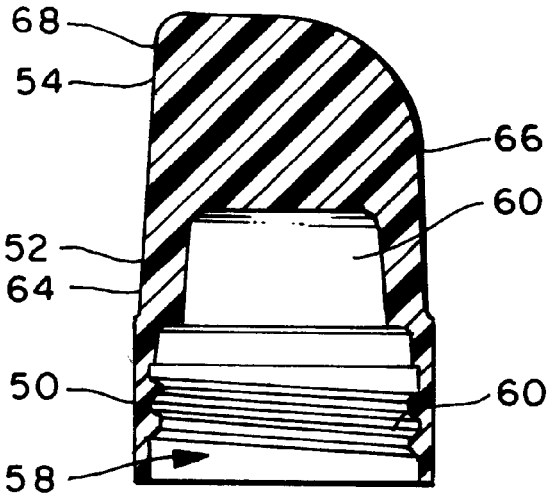
FIG. 6 is a cross-section of the tool seen in FIGS. 4 and 5 taken along lines 6—6 of FIG. 5.

Referring now to the drawings wherein the showings are for the purpose of illustrating a preferred embodiment of the invention and not for the purpose of limiting the same. The figures show a bottle 10 and a combination cap/scraping tool 12. The bottle 10 is somewhat conventional. It was relatively wide front and back sides 14, 16 and relatively narrow side walls 22,24. The bottle has a bottom 26 which is somewhat indented in the center and sloping shoulders 28. The bottle is molded from a polymer material (PET) and is relatively stiff and rigid while having some flexibility as is conventional. The bottle is provided with a neck 30 at its top and the neck is provided with conventional threads 32. The neck is conventional and is shown in cross-section in detail in FIG. 3. The bottle is selected to act not only as a container but also as a rigid handle to provide leverage for the cap/scraping tool 12.

A dispenser 36 is retained in the neck 32. The dispenser has a porous top surface 38. Under the top surface is a closure disc 40 having a central aperture 42. A spring element 44 supports a tapered plug 46. In the rest condition, the tapered plug 46 is biased upwardly in the central aperture 42 of the closure disc 40 sealing the bottle and retaining the contents within the bottle. The dispenser and bottle can be used to dispense the solvent within the bottle by inverting the bottle and pressing it on the desired location of dispensing. The top surface 38 deflects into the top of the tapered plug 46 opening the central aperture 42 and dispensing a small amount of solvent. The dispenser 36 and other similar designs are available commercially. The dispenser described above is available from Dab-O-Matic Corporation of Mount Vernon, N.Y. Other similarly operating dispensers are available and could be used in the invention.

FIGS. 4–6 show the combination cap/scraping tool 12 in greater detail. The scraping tool has a cylindrical gripping portion 50, a cylindrical intermediate portion 52, and a flat blade portion 54. The gripping portion 50 and intermediate portion 52 are generally cylindrical but are tapered starting from a larger bottom to a slightly smaller top. This taper allows for ease of manufacture through an injection molding process or the like. The taper is typically about one degree. The gripping portion has a large number of vertical ridges 56 completely around its periphery. The ridges 56 can be continuous around the periphery of the cap or intermittent with intervening smooth portions. The ridges provide a sure gripping surface for the fingers. As seen in FIG. 6, the gripping portion 50 is hollow with generally cylindrical gripping portion cavity 58. The cavity 58 has a generally cylindrical side wall with threads 60 adapted to engage the threads 32 on the bottle neck 30. The gripping portion cavity 58 is slightly tapered as is conventional.

An intermediate portion cavity 60 directly communicates with the gripping portion cavity 58. The intermediate portion cavity 60 accommodates the top surface 38 of the dispenser 36 when the cap/scraping tool 12 is fully engaged on the bottle 10. Because of the cavity 60, the top surface 38 will not be depressed and liquid will be retained below the closure disc 40 in the bottle 10.

The blade portion 54 is integral with the cap and extends upwardly from the top and outwardly from the side of the intermediate portion 52. The blade portion 54 is illustrated in detail in FIGS. 7 and 8. The blade portion 54 is tapered from its bottom to its top. The blade portion bottom 64 is comprised of two relatively thick tapered sections, one on either side of the intermediate portion 52. The blade portion is relatively thick in the bottom 64 and tapers upwardly alongside the intermediate portion and for an appreciable distance above the intermediate portion at a first rate of taper. This provides a relatively gentle taper resulting in a relatively stiff or rigid blade bottom portion 64 and intermediate portion 66. Moreover, the blade bottom portion 64 is stiffened as it is integrally formed with the cylindrical intermediate portion 52.

Figure 7:
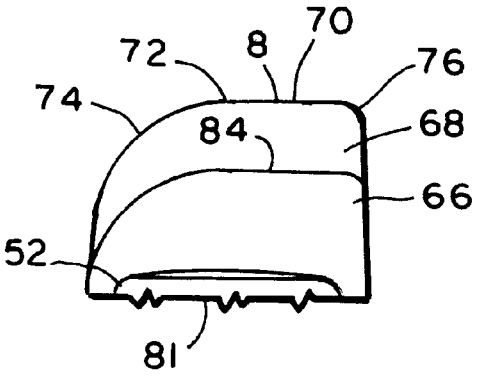
FIG. 7 is an enlarged view of the blade on the tool of FIG. 4 showing the location of taper transition.

A blade top portion 68 is integrally joined to the blade intermediate portion 66. The blade top portion 68 tapers at a higher rate than the blade intermediate portion 66 and the blade bottom portion 64. The blade up portion 68 terminates in a blade leading edge 70. As can best be seen in FIG. 7, the blade leading edge is divided into three portions. The central portion 72 is a straight edge usable in scraping paint splatters, adhesive residue, labels, and tape from flat surfaces. The leading edge left portion 74 (as seen in FIG. 7) is gently curved with a uniform large radius. The curved left edge portion 74 is usable in starting the separation of labels from flat surfaces or scraping from slightly curved or indented surfaces. A sharply curved right edge portion 76 (as seen in FIG. 7) has a very small radius of curvature and is good for starting very tightly adhering labels or tightly adhering paint splatters and the like without damaging the substrate. The plastic scraper is much less likely to damage a surface than a metal blade. Preferably, the radius of curvature of the left edge portion 74 is about four to eight times, preferably six times, the radius of curvature of the right edge portion 76. Thus, distinctly sharp right edge portion 76 is presented and a distinctly gently curved left edge portion 74 is presented as well as a straight edge portion 72. Right and left are reversed in FIG. 6.

Figure 8:
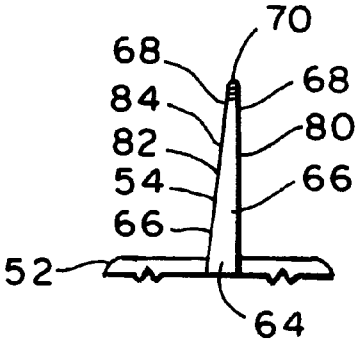
FIG. 8 is an end view of the blade shown in FIG. 7.

As can be seen in FIG. 8, the blade 54 has a flat planar back surface 80. The blade has a front surface 82 that is not entirely planar. Rather, the blade front surface 82 is broken into two planar regions, one planar region forming the front surface of the blade top portion 68 and the second planar region forming the front of the blade intermediate portion 66 and blade bottom portion 64. The front surface 82 and the back surface 80 taper toward one another at a first rate over the bottom portion 64 and intermediate portion 66; and, a second greater rate over the top portion 68. The intermediate portion 66 and the top portion 68 are separated from one another along a line 84 which is generally parallel to the leading edge 70. Thus, the separation line 84 is gently curved on the left side, straight in the middle and sharply curved at its right end. The right end curve can be omitted. As can best be seen in FIG. 8, this results in a relatively thick cross-section for the blade in the bottom portion 64 and the intermediate portion 66. These portions of the blade will be relatively stiff, durable and strong. The blade top portion 68, which is the portion closest to the leading edge 70, tapers more rapidly. As it gets thinner, it will get more flexible. It will be more flexible than the bottom portion 64 and the intermediate portion 66. This allows the leading edge to flex slightly, conform to a surface upon which it is working and cleanly remove labels, adhesives and paint splatters. This flexibility allows the leading edge to adjust to imperfections in the substrate while still being stiff enough to remove aggressive adhesives, labels and polymer films.

As can be seen best in FIG. 8, the blade back surface 80 and front surface 82 join the blade leading edge 70 with relatively sharp edges.

Approximate dimensions for a preferred embodiment of the invention are as follows. For a 24-mm nominal bottleneck, the entire cap/scraping tool 12 will be about 1⅝ inches from top to bottom. The total width of the gripping portion 50 of its bottom extremity will be about one inch. All portions of the cap/scraping tool will taper inwardly from this one inch dimension. The sizes of the gripping portion cavity and intermediate portion cavity are conventionally selected to mate with the conventional bottleneck and applicator described hereinabove. The blade 54 bottom portion 64 and intermediate portion 66 will have about a one degree inward taper. The blade 54 at its widest part is about 0.1 inch thick and tapers to about 0.07 inch thick at the straight portion of the separation line 84. The straight portion of the separation line 84 is about ⅞ inch from the bottom of the blade 54 where it meets the gripping portion 50. The blade top portion 68 extends about 5/16 inch above the straight central portion of the separation line 84. Above the separation line 84, the blade tapers more rapidly from 0.07 inch thick to 0.03 inch thick at the blade leading edge 70.

The radius in curvature of the sharp right edge portion 76 is approximately 1/16 inch. The radius of curvature of the gently curved left edge portion 74 is approximately ⅜ inch. Thus, the ratio of the radius of curvature between the large curvature left edge portion 74 and the sharp curvature right edge portion 76 is about 6 to 1.

The cap/scraping tool 12 is preferably formed from a uniform material such as polypropylene or nylon. The cap/scraping tool 12 can be formed by injection molding or compression molding. Other plastic materials such as low density polyethylene, high density polyethylene, polyvinyl chloride, ABS, polycarbonate, or other appropriate materials can be used. Fillers can be added as desired. However, the finished cap/scraping tool 12 is preferred to be non-brittle, slightly elastic and slightly flexible in its thinner section. The material is selected to have a Shore D hardness in the range of 60 to 85, preferably 78–82. This will be the reading if the material is tested in an appropriate test specimen as specified by ASTM or near the base of the blade 54. If the finished tool 12 is tested near the leading edge of the blade 54, the apparent Shore D hardness will be in the range of 35–60, preferably 48–52 because of the relative thinness of the blade top portion 68.

The preferred embodiment of the invention is fabricated from uniform material. However, it is possible to vary the characteristics of the material so that, for instance, the top of the blade is more flexible by changing the fill component or polymer fabrication in the top. Thus, a graded fill wherein more fill is provided in the bottom of the cap than in the top can alter the characteristics of flex and stiffness. Additionally, the cap/scraping tool 12 can be fabricated as a two-part component in which a blade of one material, e.g., metal, is permanently joined to a cap in the intermediate portion of a second material, e.g., nylon.

As can be seen in FIG. 1, the blade is usable when the cap/scraper is on the bottle 10. This allows for a large gripping surface for the user while conveniently presenting the blade to the surface being cleaned. Alternatively, as seen in FIG. 4, the blade can be used removed from the bottle when one wishes to work in a tight space or work on a very delicate substrate. When the blade is used on the bottle, the dispenser in the neck prevents the space between the cap/scraping tool 12 and the bottle 10 from filling with solvent. This is important as one can remove the cap from the bottle for the next application of solvent without losing solvent which has been trapped in the thread area.

Appropriate solvents for with the invention can be selected to address specific needs if a specific adhesive is to be removed. Generalized adhesive removing solvents are commercially available from sources such as Apollo Industries, Inc. of Smyrna, Ga. and from Henkel KGas of Dusseldorf, Germany and its affiliate, Loctite of Rocky Hill, Conn.

Figure 9:
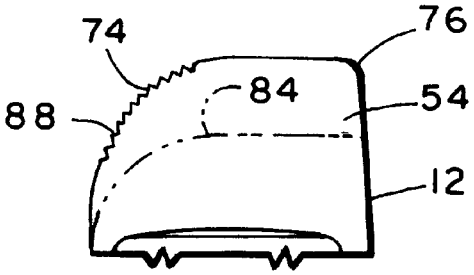
FIG. 9 is a view similar to FIG. 7 showing the second embodiment of the blade.

A second embodiment of the blade 54 of the cap/scraping tool 12 of the present invention is shown in FIG. 9. The cap/scraping tool 12 shown in FIG. 9 is identical to that seen in FIGS. 4–8 except that the left edge portion 74 of the leading edge 70 has serrations 88. The serations are particularly usable for breaking up splatters of paint and the like. This embodiment of the invention can be used in cleaning window glass after painting includes a flat blade central portion 72, a sharp right edge portion 76 and a gently curved left edge portion 74 having serrations 88 thereon.

The tool of the present invention is preferably used as follows. The cap/scraping tool 12 is removed from the bottle 10 and the bottle inverted. Solvent from within the bottle is dispensed onto the adhesive, paint or other material to be removed by dabbing the dispenser top surface 38 against the material. If a label is being removed, solvent is applied near an edge. The cap/scraper is then reapplied to the bottle or used alone to gently remove the adhesive, paint or label from the substrate. For flat surfaces, the flat central portion of the leading edge is used. If a label or splatter of paint is strongly affixed, one of the two side portions is used to start the removal process. If the substrate is other than flat, one of the two side portions 74, 76 are used to more closely fit the tool to the substrate being cleaned. If one is removing paint splatters, adhesive residues or the like from a groove in a surface of an automobile body seam, one can use the sharp right edge portion 76 at various to penetrate the groove or seam. Importantly, the leading edge 70 of the blade 54 is somewhat flexible and will deform to conform to the shape of the surface being acted upon. Because the blade top portion 68 is plastic and has a lowered "apparent" hardness, it is unlikely to scratch or injure the substrate.

The invention has been described with reference to preferred embodiments. Obviously, modifications and alterations will occur to others upon a reading and understanding of the specification and it is intended to include such modifications and alterations insofar as they come within the scope of the appended claims.

Having thus described the invention, it is so claimed:

1. An adhesive film remover tool comprising:

a bottle adapted to contain a liquid solvent having a generally cylindrical top portion having an opening; and, a cap having a generally cylindrical closure portion having an axis adapted to engage said bottle top portion and close said bottle opening and a scraper portion extending from said closure portion parallel to said axis, said scraper portion being substantially planar with a bottom end joining said closure portion, a first side edge, a second side edge and a top edge, said top edge having a straight central portion, a first corner portion having first radius of curvature, said first corner portion adjoining said first side edge, and a second corner portion having a second radius of curvature, said second corner portion adjoining said second side edge, said second radius of curvature being substantially greater than said first radius of curvature.

2. The tool of claim 1, wherein said second radius of curvature is at least four times said first radius of curvature.

3. The tool of claim 1, wherein said scraper portion has a first side and a second side and is tapered such that said first side is closer to said second side at said top edge than at said bottom end.

4. The tool of claim 3, wherein said scraper portion comprises a lower region adjacent said bottom end and an upper region adjacent said top edge, said lower region tapering at a first rate and said upper region tapering at a second rate greater than said first rate.

5. The tool of claim 4, wherein said lower region adjoins said upper region along a line generally parallel to said top edge.

6. The tool of claim 1, wherein said closure portion is generally cylindrical and has an outside surface texture adapted for firm gripping.

7. The tool of claim 1, wherein said cap is a unitary plastic structure.

8. The tool of claim 7, wherein scraper portion is relatively rigid near said bottom end and relatively flexible near said top edge.

9. The tool of claim 8, wherein said cap is fabricated from a plastic having a hardness in the bulk state in the range of 60 to 85 on the Shore D scale.

10. The tool of claim 9, wherein said cap has an apparent hardness in the range of 35 to 60 on the Shore D scale near said top edge.

11. The tool of claim 9, wherein said cap is fabricated from a plastic having a hardness in the bulk state in the range of 78 to 82 on the Shore D scale.

12. The tool of claim 11, wherein said cap has an apparent hardness in the range of 48 to 52 on the Shore D scale near said top edge.

13. The tool of claim 1, wherein a portion of said top edge is serrated.

14. A unitary plastic adhesive film remover tool having a generally cylindrical gripping portion having an axis extending generally parallel to an outer curved surface of said generally cylindrical gripping portion and a blade portion extending from said gripping portion parallel to said axis, said blade portion being substantially planar and having a leading edge with a substantially straight portion, a first sharply arcuate portion and a second gently arcuate portion.

15. The tool of claim 14, wherein said first sharply arcuate portion has a first radius of curvature and said second gently arcuate portion has a second radius of curvature and said second radius of curvature is at least four times said first radius of curvature.

16. The tool of claim 15, wherein said second radius of curvature is from about four to about eight times said first radius of curvature.

17. The tool of claim, 15 wherein said second radius of curvature is about six times said first radius of curvature.

18. The tool of claim 14, wherein said blade portion has a first side, a second side, a top edge and a bottom end, and is tapered such that said first side is closer to said second side at said top edge than at said bottom end.

19. The tool of claim 18, wherein said blade portion is relatively rigid near said bottom end and relatively flexible near said top edge.

20. The tool of claim 19, wherein said tool is fabricated from a plastic having a hardness in the bulk state in the range of 60 to 85 on the Shore D scale.

21. The tool of claim 20, wherein said tool has an apparent hardness in the range of 35 to 60 on the Shore D scale near said top edge.

22. The tool of claim 20, wherein said tool is fabricated from a plastic having a hardness in the bulk state in the range of 78 to 82 on the Shore D scale.

23. The tool of claim 22, wherein said tool has an apparent hardness in the range of 48 to 52 on the Shore D scale near said top edge.

24. The tool of claim 18, wherein said blade portion comprises a lower region adjacent said bottom end and an upper region adjacent said top edge, said lower region tapering at a first rate and said upper region tapering at a second rate greater than said first rate.

25. The tool of claim 24, wherein said lower region adjoins said upper region along a line generally parallel to said top edge.

26. The tool of claim 14, wherein said gripping portion has an outside surface texture adapted for firm gripping.

27. An adhesive film remover tool comprising:

a bottle having a generally cylindrical top portion having an opening;

a normally closed dispenser closing said bottle opening;

said dispenser adapted to dispense a portion of a solvent contained in said bottle when said dispenser is pressed against a substrate; and, a cap having a generally cylindrical closure portion having an axis adapted to close said bottle opening and cover said dispenser and a scraper portion extending from said closure portion parallel to said axis, said scraper portion being substantially planar and having a bottom end joining said closure portion, a first side edge, a second side edge and a top edge, said top edge having a straight central portion, a first corner portion having first radius of curvature, said first corner portion adjoining said first side edge, and a second corner portion having a second radius of curvature, said second corner portion adjoining said second side edge, said second radius of curvature being substantially greater than said first radius of curvature.

28. The tool of claim 27, wherein said second radius of curvature is about six times said first radius of curvature.

29. The tool of claim 27, wherein said scraper portion has a first side and a second side and is tapered such that said first side is closer to said second side at said top edge than at said bottom end.

30. The tool of claim 29, wherein said scraper portion comprises a lower region adjacent said bottom end and an upper region adjacent said top edge, said lower region tapering at a first rate and said upper region tapering at a second rate greater than said first rate.

31. The tool of claim 30, wherein said lower region adjoins said upper region along a line generally parallel to said top edge.

32. The tool of claim 27, wherein said closure portion is generally cylindrical and has an outside surface texture adapted for firm gripping.

33. The tool of claim 27, wherein said cap is a unitary plastic structure.

34. The tool of claim 33, wherein said scraper portion is relatively rigid near said bottom end and relatively flexible near said top edge.

35. The tool of claim 34, wherein said tool is fabricated from a plastic having a hardness in the bulk state in the range of 60 to 85 on the Shore D scale.

36. The tool of claim 35, wherein said tool is fabricated from a plastic having a hardness in the bulk state in the range of 78 to 82 on the Shore D scale.

* * * * *